US005552565A

United States Patent [19]

Cartier et al.

[11] Patent Number: 5,552,565

[45] Date of Patent: Sep. 3, 1996

[54] MULTICONDUCTOR SHIELDED TRANSDUCER CABLE

[75] Inventors: Paul Cartier, Acton; Wojtek Sudol, Burlington, both of Mass.; Gregory G. Vogel, Eliot, Me.

[73] Assignee: Hewlett-Packard Company, Palo Alto, Calif.

[21] Appl. No.: 414,392

[22] Filed: Mar. 31, 1995

[51] Int. Cl.[6] ..... H01B 7/08

[52] U.S. Cl. ..... 174/117 F; 174/117 FF; 174/131 A; 333/243

[58] Field of Search ..... 174/36, 117 FF, 174/117 F, 131 A, 113 C; 333/243

[56] References Cited

U.S. PATENT DOCUMENTS

| | | | |
|---|---|---|---|
| 1,795,209 | 3/1931 | Haugwitz . | |
| 3,168,617 | 2/1965 | Richter | 174/117 F |
| 3,582,532 | 1/1971 | Plummer | 174/36 |
| 3,763,306 | 10/1973 | Marshall | 174/115 |
| 3,818,117 | 6/1974 | Reyner, II et al. | 174/36 |
| 3,876,964 | 4/1975 | Balaster et al. | 333/84 |
| 4,185,162 | 1/1980 | Bogese, II | 174/32 |
| 4,304,713 | 12/1981 | Perelman | 264/45.9 |
| 4,435,614 | 3/1984 | McAusland | 174/117 PC |
| 4,443,277 | 4/1984 | Rokas | 156/50 |
| 4,529,564 | 7/1985 | Harlow | 264/127 |
| 4,652,772 | 3/1987 | Shephard | 174/117 F |
| 4,695,679 | 9/1987 | Strauss et al. | 174/117 FF |
| 4,719,319 | 1/1988 | Tighe, Jr. | 174/106 R |
| 4,783,579 | 11/1988 | Brandolf et al. | 174/117 FF |
| 4,952,041 | 11/1990 | Crawley et al. | 174/36 |
| 5,105,055 | 4/1992 | Mooney et al. | 174/27 |
| 5,235,132 | 8/1993 | Ainsworth et al. | 174/36 |
| 5,250,127 | 10/1993 | Hara | 156/52 |
| 5,360,944 | 11/1994 | Springer et al. | 174/117 F |
| 5,428,187 | 6/1995 | Crane et al. | 174/36 |
| 5,446,239 | 8/1995 | Mitzutani et al. | 174/36 |

*Primary Examiner*—Kristine L. Kincaid
*Assistant Examiner*—Chau N. Nguyen
*Attorney, Agent, or Firm*—John L. Imperato

[57] ABSTRACT

A low cost shielded transducer cable provides electrical connection between an ultrasound transducer and a display processor. A wound transducer cable is constructed in a first embodiment using two layers of stripline assemblies helically wound in opposite directions around a flexible core. The layers of stripline assemblies are covered with a single metal braid and then coated with insulation. In a second embodiment a stripline transducer cable is formed from a stack of parallel stripline assemblies that may be coextruded with an insulating jacket. In a third embodiment a ribbon transducer cable is formed from a stacked arrangement of parallel ribbon cables and conducting shields that may be extruded in an insulating material.

13 Claims, 5 Drawing Sheets

MULTICONDUCTOR SHIELDED TRANSDUCER CABLE

BACKGROUND AND SUMMARY OF THE INVENTION

Ultrasound systems are used by physicians and medical technicians as a diagnostic tool to view human body structures such as organs and tissues. For example, ultrasound systems provide real-time moving images of the heart and excellent soft tissue images of the abdomen, making ultrasound systems useful for diagnosing heart problems and indispensable for monitoring pregnancies. Images are produced without the harmful radiation of X-rays and without the long image acquisition time of magnetic resonance imaging (MRI).

In order to view a body structure, an electrical signal is generated and propagated via a cable to a transducer which converts the electrical signal into an ultra-high frequency sound (i.e., ultrasound) signal that is aimed at the body structure. The transducer also receives the ultrasound signal after it is attenuated and reflected by the body structure and converts it back into an electrical signal which is carried by the transducer cable to a display processor. The transmitted and received electrical signals are compared by the display processor which then generates an image of the body structure from the compared signals. Any disturbances on the transducer cable will degrade the image of the body structure and may cause faulty diagnoses. The transducer cable must be shielded to prevent electrical sources from interfering with the electrical signals and should be flexible so that the transducer may be easily maneuvered and aimed. Flexibility is especially important in transesophageal echocardiography (TEE) applications in which the transducer is placed down the esophagus to obtain high quality images of the heart.

Unfortunately, prior art transducer cables that are flexible and shielded are also expensive to manufacture and in many ultrasound systems the transducer cable may cost as much to manufacture as the transducer itself. One prior art transducer cable used in Hewlett-Packard Company's HP SONOS 1500 ultrasound system is constructed from many small diameter coaxial wires (36 AWG or smaller) bundled into a cable jacket. This type of transducer cable may be expensive to manufacture because the performance of each coaxial wire relies on a precise concentricity of a center conductor and a outer shield throughout its length.

In accordance with a first illustrated preferred embodiment of the present invention a wound transducer cable is flexible in all directions, shielded and is inexpensive to manufacture. In the wound transducer cable several stripline assemblies are helically wound around a flexible core and a conductive shield is braided over the stripline assemblies and encased in an outer insulating jacket. Signal wires present in the stripline assemblies are shielded by a conductive strip within each stripline assembly and by the conductive shield. In accordance with a second illustrated preferred embodiment of the present invention a stripline transducer cable is flexible and shielded and has a low manufacturing cost. A stack of parallel stripline assemblies, a conducting shield and an insulating jacket are co-extruded to form the flexible stripline transducer cable having many signal conductors. A conducting strip within each stripline assembly and the conducting shield provide shielding for the sensitive electronic signals to be transmitted over the stripline transducer cable. In accordance with a third illustrated preferred embodiment of the present invention, a ribbon transducer cable has the same flexible, shielded and low cost characteristics as the stripline transducer cable. This ribbon transducer cable is constructed from a stack of parallel ribbon assemblies co-extruded with parallel shield conductors and a flexible insulating jacket.

DETAILED DESCRIPTION OF THE PREFERRED EMBODIMENT

Figure 1:
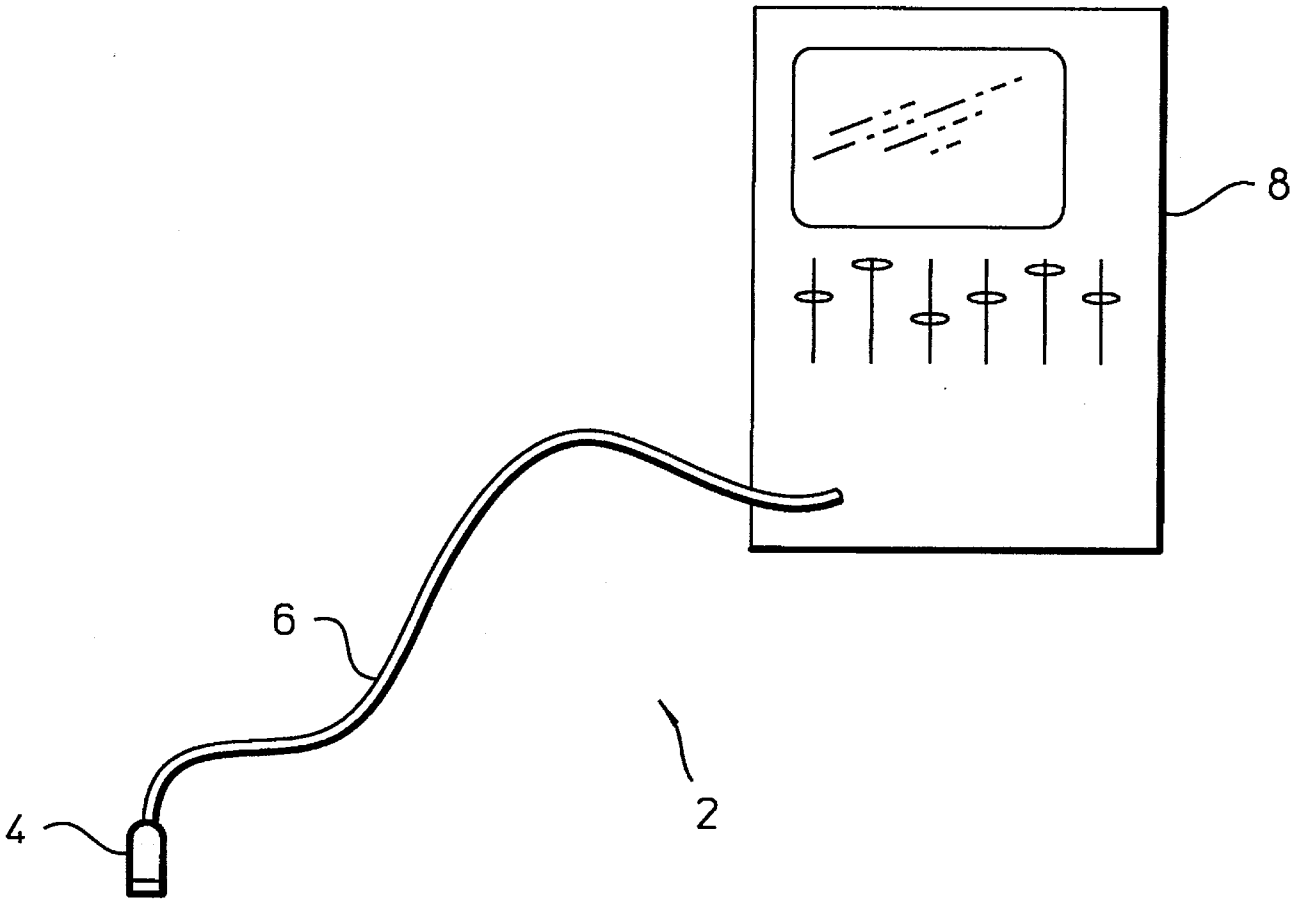
FIG. 1 (PRIOR ART)
FIG. 1 shows a prior art ultrasound system including a shielded transducer cable.

FIG. 1 shows a prior art ultrasound system 2 including a shielded transducer cable 6. The shielded transducer cable 6 provides electrical connection between a transducer 4 and a display processor 8. The transducer 4 may be held by a physician or medical technician and positioned in proximity to a human body structure such as the heart, allowing an ultrasound image of the body structure to be observed on the display processor 8.

Figure 2:
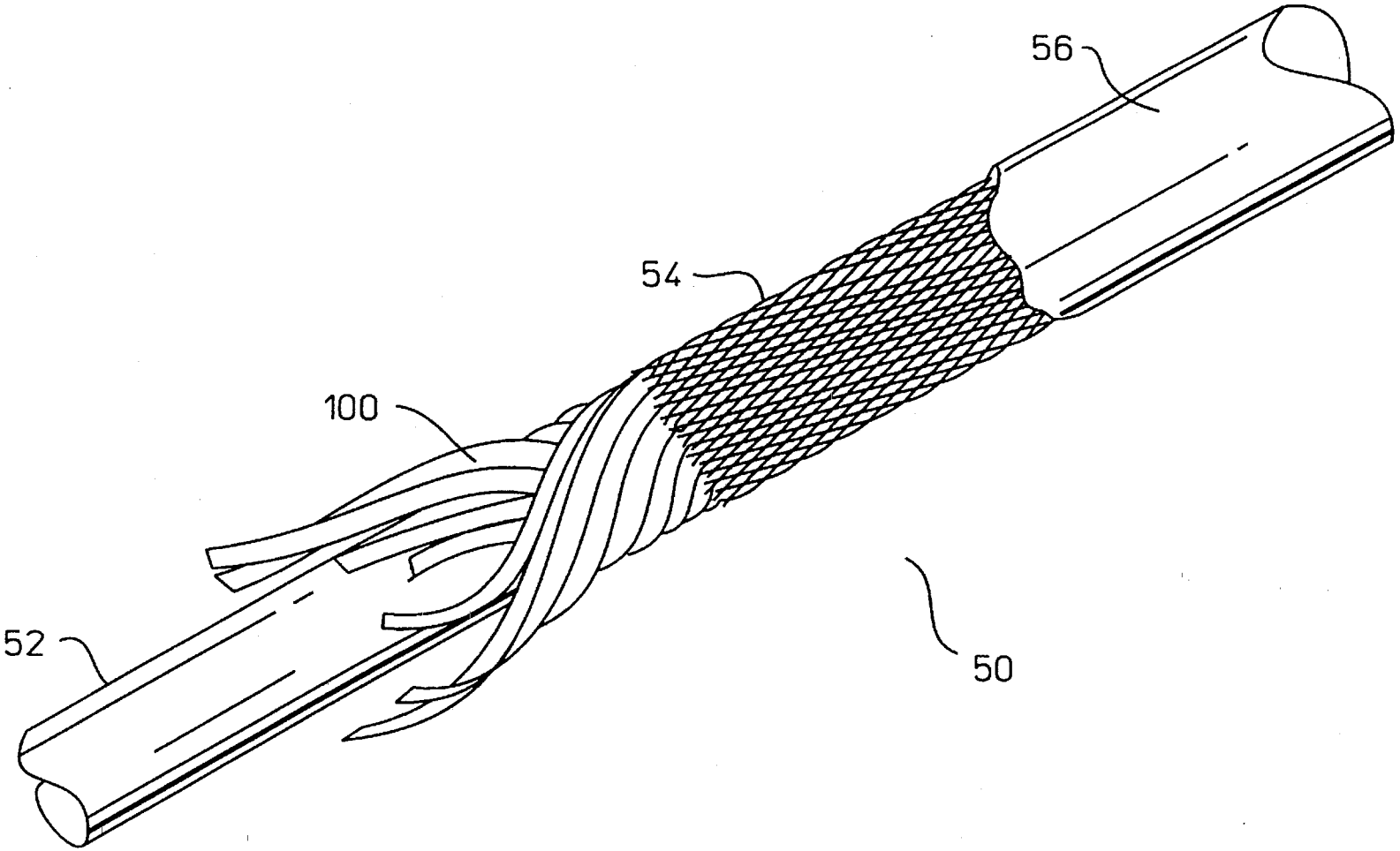
FIG. 2 shows a perspective view of a wound transducer cable that is constructed in accordance with a first preferred embodiment of the present invention.

FIG. 2 shows a perspective view of a wound transducer cable 50 that is constructed in accordance with a first preferred embodiment of the present invention to be flexible, shielded and to have a low manufacturing cost. The wound transducer cable 50 uses two layers of striplines 100 helically wound around a flexible core 52. Each of the two layers in this example contains six striplines 100 and each layer is wound in the opposite direction of the other. A metal shield 54 may be constructed from stainless steel and braided over the two layers of the striplines 100, and an insulating, flexible protective jacket 56 is formed over the metal shield 54. The metal shield 54 used in this example is braided but it could also be formed by other means such as by winding a metal layer over the striplines 100 or by the placement of an electrical conductor between the striplines 100 and the protective jacket 56. The resulting wound transducer cable 50 is circular in cross-section and in this example has a diameter of 0.300" and is capable of achieving a bend radius of 0.5" under normal use. Each of the total of twelve striplines 100 used in the construction of the wound transducer cable 50 contains eight signal conductors providing a total of ninety six signal conductors. The conductive strips 180 within the stripline assemblies 100 shown in FIG. 3 and the braided metal shield 54 may be connected to ground or another potential to provide shielding for the sensitive electrical signals that travel on the wound transducer cable 50. The wound transducer cable 50 has a low manufacturing cost because it is formed from low cost striplines 100 and because it is not labor intensive to wind the striplines 100 around the flexible core 52 and to apply the metal shield 54 and the protective jacket 56.

Figure 3:
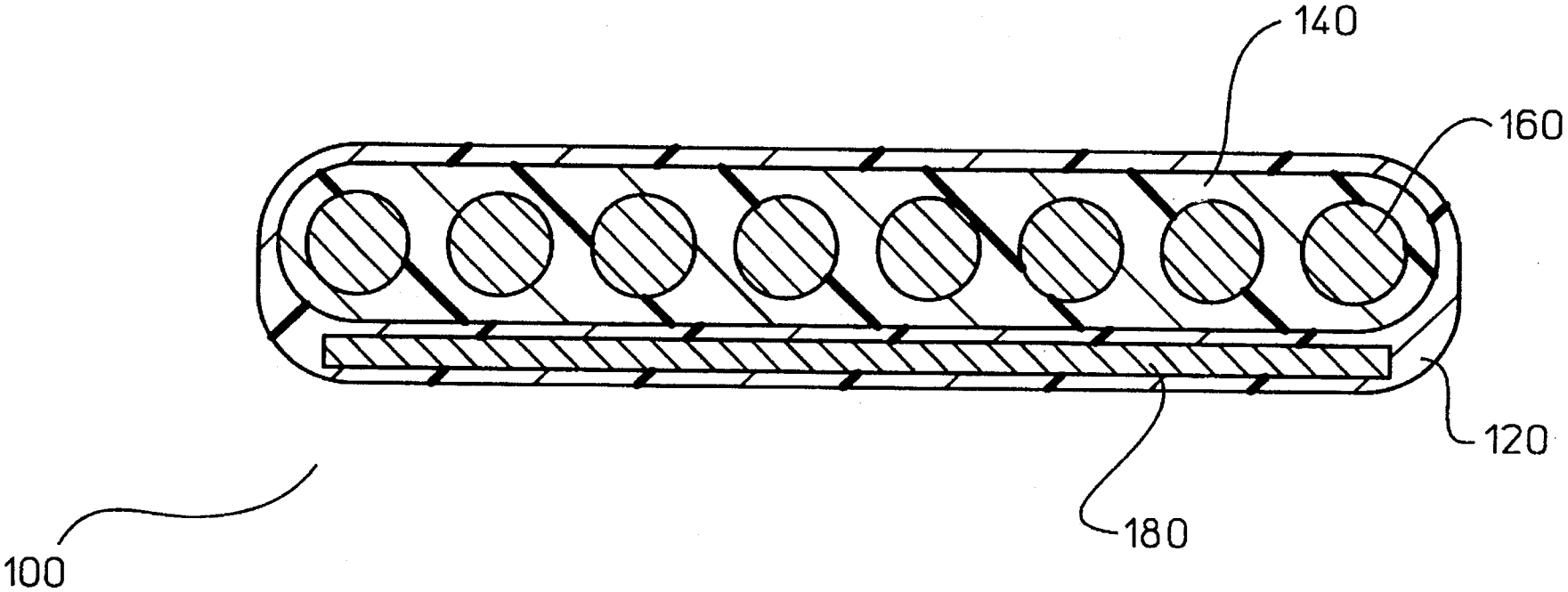
FIG. 3 shows a cross-sectional view of a stripline that is used in the construction of the first preferred embodiment of the present invention shown in FIG. 2.

FIG. 3 shows a cross-sectional view of a stripline 100 that used in the construction of the first preferred embodiment of the present invention shown in FIG. 2. In this example, each stripline 100 consists of eight parallel conductors 160 constructed from silver plated 42 AWG sized solid copper wire each having a coating of a flexible insulating material such as PFA to form a first insulator 140. A conductive strip 180 is formed from a thin strip of bare copper to shield the conductors 160 and is placed beneath the first insulator 140 parallel to the conductors 160. The combination of the first insulator 140, conductors 160 and conductive strip 180 is extruded and encased by a second insulator 120 to form a desired length of the stripline 100. The second insulator 120 is thin and may also be fabricated from a flexible insulating material such as PFA. In this example the striplines 100 produced by the extrusion have a width of 0.058" and a thickness of 0.015".

Figure 4:
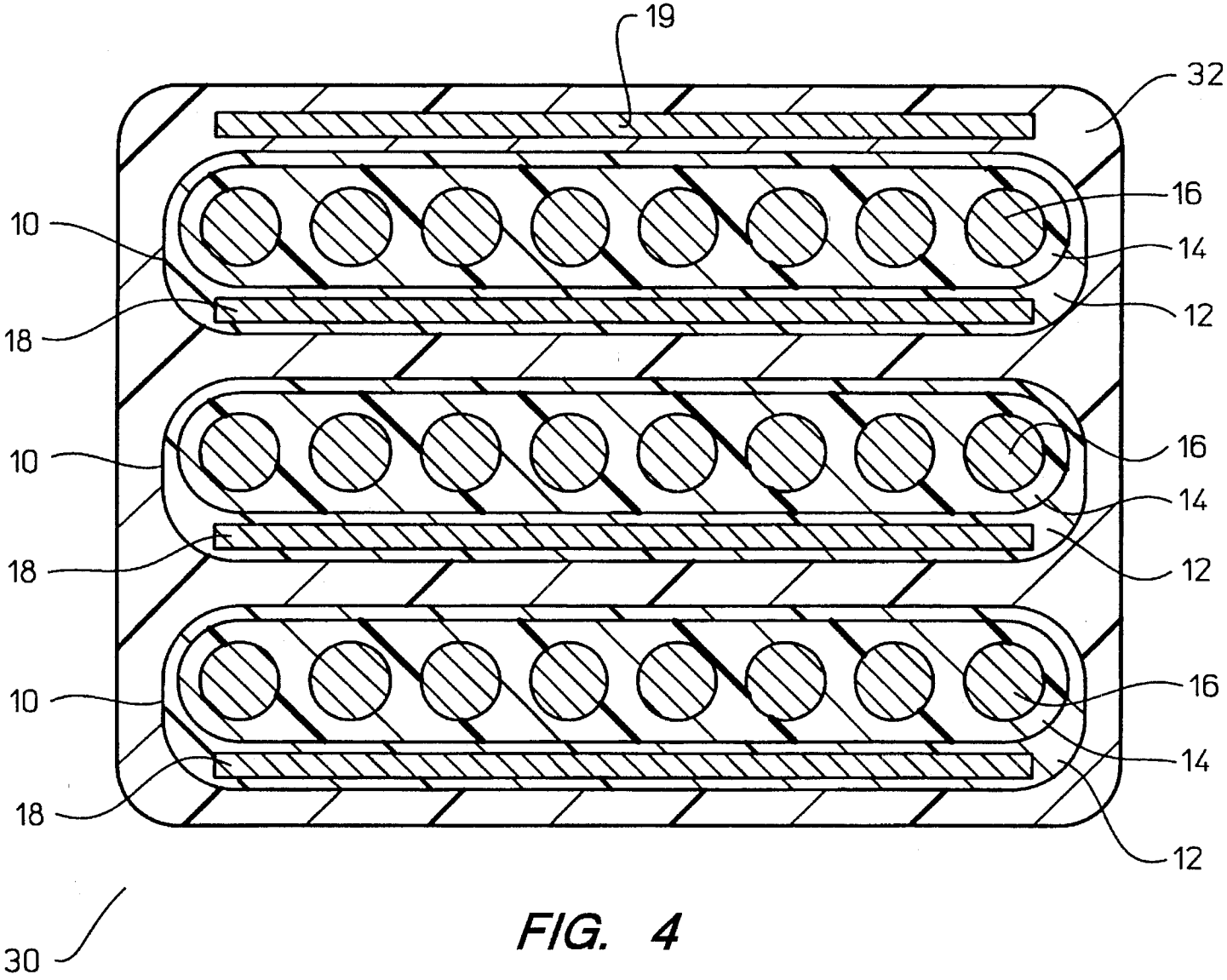
FIG. 4 shows a cross-sectional view of a stripline transducer cable that is constructed in accordance with a second embodiment of the present invention.

FIG. 4 shows a cross-sectional view of a flexible, shielded, low cost stripline transducer cable 30 that is constructed in accordance with a second preferred embodiment of the present invention in which three parallel stripline assemblies 10 are stacked on top of each other. Each stripline assembly 10 in this example consists of eight parallel signal conductors 16 constructed from silver plated 42 AWG sized solid copper wire that is coated with a flexible insulating material such as PFA to form an inner insulation 14. A conducting strip 18 is formed from a thin strip of bare copper to shield the signal conductors 16 and is placed beneath the inner insulation 14 and parallel to the signal conductors 16. The combination of the inner insulation 14, signal conductors 16 and conducting strip 18 is then extruded and encased by an outer insulation 12 to form a desired length of the stripline assembly 10. The outer insulation 12 may also be fabricated from a flexible insulating material such as PFA.

Once the stripline assemblies 10 are constructed, a jacket shield 19 is fabricated from a conducting material such as copper and positioned on top of three stripline assemblies 10 to provide shielding for the signal conductors 16 of the top stripline assembly 10 in the stack. The jacket shield 19 and the three stripline assemblies 10 are then coextruded with an insulating jacket 32 to form the stripline cable 30. In cross-section, the resulting stripline cable 30 in this example is 0.06" in height by 0.062" in width and has twenty four signal conductors 16.

Many signal conductors 16 may be incorporated within the stripline transducer cable 30 because the small wires used to form the signal conductors 16 are flexible. The thin conducting strips 18 and the thin jacket shield 19 may be connected to ground or another potential to provide shielding for the sensitive electronic signals present on the signal conductors 16. The choice of a flexible material such as PFA for the inner insulation 14, outer insulation 12 and the insulating jacket 32 makes the stripline transducer cable 30 flexible. The formation of the stripline assemblies 10 and the stripline transducer cable 30 by extrusion provides a low manufacturing cost for the stripline transducer cable 30.

Figure 5:
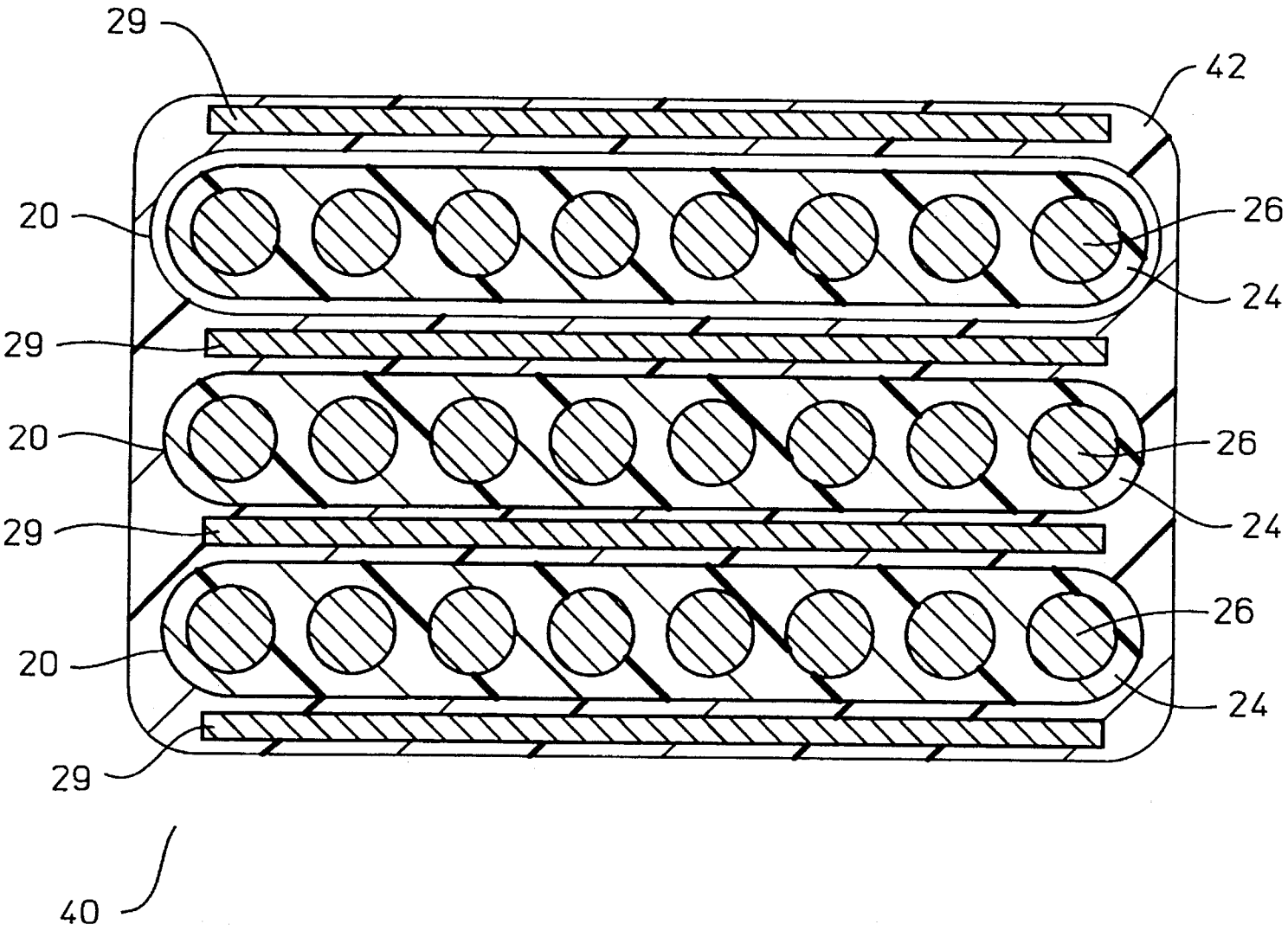
FIG. 5 shows a cross-sectional view of a ribbon transducer cable that is constructed in accordance with a third embodiment of the present invention.

FIG. 5 shows a cross-sectional view of a ribbon transducer cable 40 that is constructed in accordance with a third preferred embodiment of the present invention to be flexible, shielded and to have a low manufacturing cost. The ribbon transducer cable 40 is constructed from a stack of three ribbon assemblies 20. Each ribbon assembly 20 in this example contains eight parallel electrical conductors 26 constructed from silver plated solid copper core 42 AWG sized wire that are each coated with a flexible insulating material such as PFA to form the ribbon insulation 24. Each ribbon assembly 20 is 0.050" wide and 0.0065" thick.

The ribbon transducer cable 40 is constructed using the three ribbon assemblies 20 and four shield conductors 29 formed from thin strips of bare copper. A shield conductor 29 is placed above and beneath each of the ribbon assemblies 20 and the stack of ribbon assemblies 20 and shield conductors 29 are co-extruded with a ribbon jacket 42 to form a desired length of the ribbon transducer cable 40. The low cost extrusion process produces a ribbon cable 40 having twenty four electrical conductors 26. The shield conductors 29 may be connected to ground or another potential to provide shielding for the electrical conductors 26. The ribbon insulation 24 and the ribbon jacket 42 are flexible and since the ribbon assemblies 20 and the ribbon transducer cable 40 are formed by extrusion, the ribbon transducer cable 40 has a low manufacturing cost.

We claim:

1. A flexible transducer cable for connecting a display processor to a transducer, comprising:

multiple ribbon assemblies arranged in a stack, each ribbon assembly including, a plurality of parallel coplanar conductors, a continuous electrical insulator encasing and separating the parallel coplanar conductors, and a shield conductor in contact with the electrical insulator, parallel to the parallel coplanar conductors and positioned below the parallel coplanar conductors;

a top shield conductor positioned at the top of the stack; and an insulating jacket encasing the ribbon assemblies and the top shield conductor.

2. A flexible transducer cable as in claim 1, wherein the shield conductor of each ribbon assembly in the stack is adjacent to the plurality of parallel coplanar conductors of an adjacent ribbon assembly in the stack.

3. A flexible transducer cable as in claim 2, wherein the stack of multiple ribbon assemblies and the top shield conductor are parallel and the top shield conductor is positioned adjacent to the plurality of parallel coplanar conductors of the ribbon assembly at the top of the stack.

4. A flexible transducer cable as in claim 3, wherein the top shield conductor is substantially equal in width to the shield conductor of each ribbon assembly.

5. A flexible transducer cable as in claim 4, wherein each ribbon assembly of the stack further includes a second electrical insulator encasing the continuous electrical insulator and the shield conductor.

6. A flexible transducer cable as in claim 5, wherein the continuous electrical insulator, the second electrical insulator and the insulating jacket are fabricated from PFA.

7. A flexible transducer cable assembly as in claim 4, wherein the continuous electrical insulator and the insulating jacket are fabricated from PFA.

8. A flexible transducer cable for connecting a display processor to a transducer, comprising:

a pair of striplines, each stripline including, a plurality of parallel coplanar conductors, an inner insulator encasing and separating the conductors, a conducting strip adjacent to the inner insulator and parallel to the conductor, and an outer insulator encasing the inner insulator and the conducting strip:

a flexible core, having the first stripline of the pair helically wound around the flexible core in a first direction, such that the conducting strip of the first stripline is adjacent to the flexible core, and having the second stripline of the pair helically wound around the first stripline in a second direction;

a braided metal shield covering the helically wound pair of striplines; and a protective jacket encasing the braided metal shield Please delete claim 12 without prejudice.

9. A flexible transducer cable as in claim 8, wherein the flexible core is circular in cross-section.

10. A flexible transducer cable as in claim 9, wherein the plurality of parallel coplanar conductors and the conducting strip of each stripline have substantially equal widths.

11. A flexible transducer cable as in claim 10, wherein the outer insulator and the inner insulator are fabricated from PFA.

12. A flexible transducer cable as in claim 11, wherein the braided metal shield is fabricated from stainless steel.

13. A flexible transducer cable as in claim 12, wherein the protective jacket is fabricated from polyvinylchloride (PVC).

* * * * *

UNITED STATES PATENT AND TRADEMARK OFFICE

CERTIFICATE OF CORRECTION

PATENT NO : 5,552,565
DATED : September 3, 1996
INVENTOR(S) : Paul Cartier, et al It is certified that error appears in the above-identified patent and that said Letters Patent is hereby corrected as shown below:

Column 5, line 6, delete: "Please delete claim 12 without prejudice."

Signed and Sealed this

Thirteenth Day of October 1998

*Attest:*

Bruce Lehman

BRUCE LEHMAN

*Attesting Officer*

*Commissioner of Patents and Trademarks*